US010731606B2

(12) United States Patent
Taniel

(10) Patent No.: US 10,731,606 B2
(45) Date of Patent: Aug. 4, 2020

(54) EMULSIFYING SYSTEM AND EMULSIFYING PROCESS

(71) Applicant: Roman Taniel, Pronstorf (DE)

(72) Inventor: Roman Taniel, Pronstorf (DE)

( * ) Notice: Subject to any disclaimer, the term of this patent is extended or adjusted under 35 U.S.C. 154(b) by 89 days.

(21) Appl. No.: 15/776,483

(22) PCT Filed: Nov. 21, 2016

(86) PCT No.: PCT/EP2016/025150
§ 371 (c)(1),
(2) Date: Jul. 11, 2018

(87) PCT Pub. No.: WO2017/084765
PCT Pub. Date: May 26, 2017

(65) Prior Publication Data

US 2018/0328315 A1 Nov. 15, 2018

(30) Foreign Application Priority Data

Nov. 19, 2015 (DE) ..... 10 2015 014 943

(51) Int. Cl.
*F02M 25/022* (2006.01)
*B01F 3/08* (2006.01)
(Continued)

(52) U.S. Cl.
CPC ..... *F02M 25/0228* (2013.01); *B01F 3/0807* (2013.01); *B01F 7/008* (2013.01);
(Continued)

(58) Field of Classification Search
CPC combination set(s) only.
See application file for complete search history.

(56) References Cited

U.S. PATENT DOCUMENTS 5,125,367 A * 6/1992 Ulrich ..... B01F 3/0807 123/25 E
2007/0056534 A1 3/2007 Verstallen
2012/0180741 A1 7/2012 Strey et al.

FOREIGN PATENT DOCUMENTS

CH 364492 A 9/1962
DE 3123743 A1 * 3/1982 ..... F02M 25/0228
(Continued)

OTHER PUBLICATIONS

Bach, Florian, et al. "Einfluss von Diesel-EthanolWasser emulsionskraftstoffen auf die Dieselmotor-Emissionen [Influence of diesel-ethanol-water emulsion fuels on diesel engine emissions]" MTZ May 2011, pp. 408-414.
(Continued)

*Primary Examiner* — Ellen M McAvoy
*Assistant Examiner* — Chantel L Graham
(74) *Attorney, Agent, or Firm* — Jason H. Vick; Sheridan Ross, PC

(57) ABSTRACT

What is proposed is an emulsifying system with an emulsifying device and an injection nozzle as well as an emulsifying device for producing a water-fuel emulsion for an internal combustion engine, wherein the emulsifying device is embodied as a rotor-stator emulsifying device and/or fluid flow machine and/or is connected or connectable directly to an injection nozzle. The emulsifying device has a housing and a shaft, the shaft being drivable in a contactless manner, the housing having a guide apparatus having a plurality of guide channels for guiding the flow, and/or the housing being made at least partially from fiber composite material.

14 Claims, 6 Drawing Sheets

(51) Int. Cl.

| | |
|---|---|
| ***B01F 7/00*** | (2006.01) |
| ***B01F 7/04*** | (2006.01) |
| ***B01F 13/10*** | (2006.01) |
| ***C10L 1/32*** | (2006.01) |
| ***F02D 41/00*** | (2006.01) |
| ***F02M 43/04*** | (2006.01) |
| ***B01F 13/08*** | (2006.01) |

(52) U.S. Cl.
CPC ..... *B01F 7/00908* (2013.01); *B01F 7/00916* (2013.01); *B01F 7/04* (2013.01); *B01F 13/0836* (2013.01); *B01F 13/1027* (2013.01); *C10L 1/328* (2013.01); *F02D 41/0025* (2013.01); *F02M 43/04* (2013.01); *B01F 2003/0842* (2013.01); *B01F 2003/0849* (2013.01); *B01F 2215/0088* (2013.01)

(56) References Cited

FOREIGN PATENT DOCUMENTS

| | | | | |
|---|---|---|---|---|
| DE | 3123743 | A1 | 3/1982 | |
| DE | 4412965 | A1 | 10/1995 | |
| DE | 20020142 | U1 * | 2/2001 | ..... F02M 25/0225 |
| DE | 20020142 | U1 | 2/2001 | |
| DE | 102005044046 | B4 | 1/2007 | |
| DE | 102009048223 | A1 | 6/2011 | |
| EP | 0392545 | A1 | 10/1990 | |

OTHER PUBLICATIONS

Pittermann, Roland et al., "Einfluss von Abgasrückführung und Kraftstoff-Wasser-Emulsion auf Verbrennungsablauf und Schadstoffbildung im Dieselmotor [Influence of exhaust gas recirculation and fuel-water emulsion on combustion process and pollutant formation in the diesel engine]. MTZ 60(1999)12, pp. 812-818".

International Preliminary Report on Patentability for corresponding International Application No. PCT/EP2016/025150, dated May 31, 2018.

International Search Report for corresponding International Application No. PCT/EP2016/025150, dated Apr. 18, 2017.

Written Opinion for corresponding International Application No. PCT/EP2016/025150, dated Apr. 18, 2017.

* cited by examiner

EMULSIFYING SYSTEM AND EMULSIFYING PROCESS

CROSS REFERENCE TO RELATED APPLICATIONS

This application is a national stage application under 35 U.S.C. 371 of PCT Application No. PCT/EP2016/025150 having an international filing date of 21 Nov. 2016 which designated the United States, which PCT application claimed the benefit of German Application No. 10 2015 014 943.1 filed 19 Nov. 2015, each of which are incorporated herein by reference in their entirety.

SUMMARY

The present invention relates to an emulsifying system, an emulsifying device, and an emulsifying method as set forth herein.

Diesel engine combustion is characterized in that a fuel or diesel that is capable of self-ignition is injected under very high pressure through an injection nozzle into a combustion-chamber bowl arranged in the piston. After the atomization and vaporization of the fuel in the combustion air, which has been heated to high temperatures by the compression, the fuel components that have already vaporized mix with the combustion air. This mixture formation is achieved both through the distribution of the fuel by means of 6- to 8-hole injection nozzles and by means of an air swirl generated in the inlet channels.

The chemical processing of the fuel-air mixture then takes place through cracking of the relatively long fuel molecules and the formation of active radicals. If the concentration of active radicals is sufficiently high, the auto-ignition of the fuel-air mixture begins in the form of a chain reaction.

The time required for the physical and chemical processes involved in the mixture formation is referred to as the ignition delay.

Owing to the direct injection of the fuel and the short time thus available for mixture formation, the further combustion takes place in a fuel-air mixture having a locally inhomogeneous fuel distribution. The ignition phase of this "inhomogeneous" fuel-air mixture is characterized by the occurrence of "ignition seeds" in areas of the mixture that are already ignitable.

As combustion continues, the fuel droplets that made their way into the hot, compressed combustion air at the beginning of the fuel injection react first, for which a relatively long time is thus available for mixture preparation. This combustion phase, which is also referred to as the combustion of "premixed" mixture, is characterized by higher combustion temperatures due to relatively rapid combustion reactions and thus increased thermal nitrogen oxide formation and diminished soot formation. During this first combustion phase, however, only a portion of the fuel-air mixture that is determined by the length of the ignition delay is burned.

The remainder of the required engine load-dependent mixture quantity, which is not yet ignitable at the beginning of combustion, is processed only over the further course of the combustion process as a result of sharply rising gas temperatures and an intense charge motion and is then burned in part with a deficiency of air at a relatively low combustion speed. This combustion phase, which is also referred to as "diffusion-controlled" combustion, is characterized by the initial formation of soot, which occurs in the event of local air deficiency, and subsequent, incomplete soot oxidation along with simultaneously diminished formation of nitrogen oxide (NOx).

The various phases of the combustion process and the corresponding mechanisms of pollutant formation result in an interrelationship between the nitrogen oxide and soot emissions that is typical of diesel engine combustion, also referred to as the NOx-particulate matter trade-off. This NOx-particulate matter interrelationship states that, when tuning the engine operating parameters, such as the injection timing, low NOx emissions are inevitably accompanied by an increase in soot/particulate emissions.

In order to comply with the legally prescribed pollutant emissions requirements for diesel engines, measures are taken both inside the engine and in the form of exhaust aftertreatment methods. The measures taken inside the engine includes as the most important measures for improving fuel-air mixture formation the use of high-pressure injection systems that allow for injection pressures of more than 200 MPa. The resulting improved disintegration of the injection jet into smaller fuel droplets leads to an improved mixing of the fuel with the combustion air and thus to fewer super-rich mixture zones and, accordingly, to substantially lower soot and particulate emissions.

Due to the higher combustion temperatures, mixture formation that has been intensified in this way results in commensurately higher NOx emissions, which should be avoided by increasing the air surplus through increased boost pressures and optimized injection flow rates.

Another measure is exhaust gas recirculation (EGR), which is also being increasingly used in heavy utility vehicle engines. However, the exhaust gas recirculation rate and thus also the possible reduction of NOx due to the decreasing oxygen content in the combustion air are limited by rising soot and particulate emissions.

Since the described measures that are taken inside of the engine for the purpose of reducing pollutants are not sufficient to bring exhaust emission to below the limits, so-called DeNOx catalyst systems with urea as a reducing agent and particulate filter systems known for their occasional use in passenger cars with diesel engines are being used in newly registered utility vehicle engines that must satisfy emissions classes Euro 5 and Euro 6.

In order to achieve the emissions targets, the raw emissions behavior of the diesel engine must be adapted to the exhaust aftertreatment systems used. For example, with typical Euro 5 diesel engines, particulate emissions are reduced to the corresponding limit values using flexibly tunable common rail (CR) injection systems at 160 to 180 MPa injection pressure, while nitrogen oxide emissions are usually sufficiently reduced through the use of a urea-based DeNOx system. NOx emissions are sometimes also reduced by a combination of exhaust gas recirculation and a downstream DeNOx system.

The economically justifiable process combination that is used depends essentially on the raw emissions of a diesel engine. For diesel engines of the Euro 6 emissions standard, the use of further optimized injection systems with injection pressures of 200 MPa and higher are required for further particulate emission reduction and more efficient EGR-DeNOx system combinations. In particular, the use of EGR systems with significantly higher EGR rates and of DeNOx systems with NOx conversion rates of up to 90 percent is required.

If the NOx emissions limit values cannot be met by the described use of EGR and DeNOx systems, the additional use of a particulate filter system with appropriately adjusted EGR and DeNOx systems is unavoidable.

It can therefore be said that the Euro 5 emissions standard, and especially Euro 6, which are applicable to heavy utility vehicle engines, can only be achieved with substantial additional technical and economic outlay. For all combinations of processes for reducing NOx and particulate emissions, a deterioration of the fuel consumption behavior is to be expected due to the catalyst-induced increase in exhaust-gas backpressure and potentially required adaptations of the combustion process. As a matter of principle, however, raw NOx-particulate engine emissions that are as low as possible are aspired to, since that means lower expenditures on the exhaust aftertreatment side.

In principle, besides the use of engine-internal measures and exhaust aftertreatment systems, composition-modified fuels also represent an interesting way to reduce pollutant emissions in diesel engines. There has been longstanding interest particularly in the admixture of water and other components, such as alcohols, with diesel fuel, since the nitrogen oxide-soot trade-off can be favorably influenced in this way (cf. Bach, F., Lüft, M., Bartosch, S., Spicher, U.: Einfluss von Diesel-Ethanol-Wasser-Emulsionskraftstoffen auf die Dieselmotor-Emissionen [Influence of diesel-ethanol-water emulsion fuels on diesel engine emissions], MTZ May 2011, pp. 408-414).

When water-in-diesel fuel emulsion—or water-diesel emulsion, for short—is used, either a ready-to-use water-diesel emulsion using an emulsifying additive or an emulsion that is produced on board a vehicle by the existing injection system is injected into the combustion chamber instead of pure diesel fuel. The preparation of the emulsion in the vehicle offers the advantage that the proportion of water in the mixed fuel can be selected with a relatively high degree of freedom while taking combustion limits into account in order to achieve the greatest possible reduction in pollutants.

Besides the use of water-diesel emulsions, the possibility also exists in principle of exploiting the advantageous properties of water to lower the combustion temperatures through the injection of water into the intake air and the direct injection of water into the combustion chamber.

Due to the high enthalpy of vaporization of water, substantial cooling of the intake air and/or of the combustion air in the cylinder is achieved through addition into the intake manifold and especially with direct injection, resulting in a reduction of nitrogen oxide emissions of up to 50 percent. However, due to the relatively low mixing of the diesel fuel with water in the combustion chamber and thus lower homogenization of the diesel fuel in the combustion chamber compared to emulsion fuels, the reduction in soot emissions is lower (cf. DE 10 2009 048 223 A1).

Therefore, besides their easier application in production engines, emulsion fuels offer greater potential for reducing the critical pollutant components in the exhaust gas of diesel engines.

Water-diesel emulsions can be regarded as disperse multiphase systems of at least two mixture-insoluble liquids in which water is considered to be an internal, disperse phase.

Accordingly, the diesel fuel represents the external phase, the so-called dispersing agent.

Water-diesel emulsions are thermodynamically unstable and separate after a relatively short time. Through the use of emulsifying aids, so-called emulsifiers, it is possible in principle to convert a water/diesel emulsion into a thermodynamically stable form.

One important criterion for the suitability of an emulsion as fuel for diesel engines is the finest possible distribution of the water droplets in the diesel fuel.

For mobile use, emulsions produced in the vehicle using an emulsifier or, if no emulsifier is used, emulsions produced in a corresponding mixing device are suitable.

The use of emulsions produced outside of a vehicle, available at petrol stations, for example, have a constant composition that is not adapted to the requirements of the engine operation and thus does not enable the full potential for a reduction in emissions and consumption to be realized.

The effect of water-diesel emulsions consists, on the one hand, in a temperature reduction as a result of water vaporization and, on the other hand, in reduced combustion temperatures due to the increased inert gas component in the form of water vapor. Both lead to an extension of the physical ignition delay, which leads to a more uniform (more homogeneous) distribution of the fuel in the combustion chamber and thus to a larger proportion of the "premixed" combustion.

The resulting enhanced homogenization of the mixture in conjunction with the water droplets being finely distributed in the emulsion leads to a reduction of very fuel-rich and thus over-rich areas of the mixture, which are substantially responsible for soot formation during the combustion process.

The reduction in nitrogen oxide emissions can be attributed to a substantial reduction in flame temperature both due to the high enthalpy of vaporization of the water and due to the water-induced lower local specific heat release in the combustion zone (cf. Pittermann, R., Hinz, M., Kauert, L.: Einfluss von Abgasrückführung und Kraftstoff-Wasser-Emulsion auf Verbrennungsablauf und Schadstoffbildung im Dieselmotor [Influence of exhaust gas recirculation and fuel-water emulsion on the combustion process and pollutant formation in the diesel engine], MTZ 60 (1999) 12, pp. 812-818).

Exhaust gas recirculation (EGR), which is increasingly used to reduce NOx emissions, also results in reduced flame temperatures corresponding to the increased inert gas component. Greatly increased soot emissions occur at higher EGR rates, however, which can be avoided through combination with water/diesel emulsion fuels. The use of water-diesel emulsion fuels thus increases EGR tolerance and thus the potential for NOx and soot reduction.

Another prerequisite for the optimal use of an emulsion fuel is the need to adjust the water component in the emulsion to different engine operating conditions, shutdown, and engine startup even after extended downtime.

In the starting phase of the diesel engine, a safe and quick start and rapid heating of the engine can only be achieved through pure diesel fuel operation, since stable combustion is achieved after just a few cycles. Due to the degraded auto-ignitability of the emulsion, the use of a water-diesel emulsion also in the starting phase increases the number of combustionless cycles, resulting in a corresponding increase in emissions of unburned fuel. The water component in the emulsion can be increased during the warm-up phase according to the heat up of the engine.

Due to the higher combustion chamber temperatures during largely stationary engine operation and high output, a larger proportion of water may be contained in the emulsion in order to attain a level of combustion efficiency that is as optimal as possible while simultaneously highly reducing NOx and particulate emissions.

Under lower load conditions and correspondingly lower combustion chamber temperatures, a reduction of the water component in the emulsion is required in order to prevent too excessive cooling of the flame zones and the associated increased emissions of unburned fuel. Largely stationary engine operation with only relatively slow changes in load and engine speed does not require dynamic emulsifying equipment.

In principle, it is only possible to exploit the full potential of a water-diesel emulsion for NOx and soot reduction if the water component is maintained as close as possible to the respective technical combustion limit on an operating point-dependent basis. For the dynamic operation that is typical of the automotive sector, this means that very rapid adaptation of the water component to current combustion chamber temperatures and of the oxygen content available for combustion when using the exhaust gas recirculation is absolutely necessary.

The faster the adaptation of the water component to the current operating state of the engine, the greater the emissions reduction. This is becoming ever-more important, since the emissions performance of diesel engines for utility vehicles and mobile work machines is determined using transient exhaust gas test cycles.

DE 10 2009 048 223 A1 discloses a method for producing a microemulsion in which diesel fuel and water are separated by means of two common rail injection systems and fed under high pressure to a mixing chamber arranged between the high-pressure reservoirs for diesel and water and the injection nozzle. It is in this mixing chamber that a microemulsion is formed with the emulsifier already contained in the diesel fuel. This arrangement of the relatively small mixing chamber at a short distance before the injector and the small mixing chamber volumes and injection line volumes that this makes possible are intended to enable a rapid adaptation (lasting only a few stroke cycles) of the water component in the emulsion fed to the injector to the operating point of the diesel engine. This method requires the use of special emulsifiers that enable very fast water-diesel emulsification.

A device is known from DE 10 2005 044 046 B4 that feeds water and diesel fuel by means of a mechanically or hydraulically driven stepped piston at a pressure of up to 200 MPa to a counterflow high-pressure emulsifying nozzle. The water-diesel emulsion produced is held in several spring-loaded intermediate reservoirs, which also have a damper function, and conducted via a distribution pipe to the injectors as needed. In principle, this device therefore represents a combined emulsifying and high-pressure pump that is comparable to the diesel high-pressure pump of a conventional common rail injection system. The relatively large fuel reservoir volumes in the high-pressure pump and in the distribution line to the injectors do not permit quick adaptation of the emulsion composition within a few stroke cycles. Particularly, the pure diesel operation or operation with small water fractions required during engine startup and warm-up phase requires an appropriate storage of the fuel, for example in connection with a flushing device for the high-pressure distribution line and the injection lines, which is not provided for in the published device.

Another problem is the danger of coalescence as a result of a relatively long dwell time of the emulsion in the reservoirs and injection lines, particularly at low engine load, and the associated phase separation of the water-diesel emulsion.

A method and a device for controlling the diesel fuel supply and water-diesel emulsions supply in in-line injection pumps is known from DE 44 12 965 A1 in which, depending on the load state of the engine, differently composed emulsions are generated in a mixing system and then fed to the injection pump, or there is exclusive diesel operation. In order to reduce the reaction time between the production of an altered emulsion and the injection of this emulsion, the so-called low-pressure pump chamber is flushed appropriately according to the desired increase or reduction of the water fraction in the emulsion from an emulsion or diesel reservoir. In addition, a switch from emulsion operation to pure diesel operation as a function of the operating mode is presented. In particular, the engine is to be operated with pure diesel fuel when in idle, whereas emulsion operation is switched to under greater loads. The effect of this dead time between the emulsion formation and provision thereof at the injector on the operation behavior and emissions behavior depends substantially on the system volume in the area of emulsion production and the fuel volume to be exchanged in the high-pressure region of the injection system. In any case, adaptation to dynamic operating conditions is likely to be relatively slow.

It is the object of the present invention to provide an improved system, an improved device, and an improved method for producing a water-fuel emulsion, preferably wherein the energy-efficient production of a particular homogeneous water-fuel emulsion of variable composition and/or a compact, low-maintenance, stable and/or cost-effective construction is enabled or supported.

The above object is achieved by an emulsifying system, an emulsifying device, an emulsifying method, or a use according to claims set forth herein. Advantageous developments constitute the subject matter of the subclaims.

One aspect of the present invention resides in the proposed emulsifying device being embodied as a preferably multi-stage rotor-stator emulsifying device or fluid flow machine, particularly a fluid-flow work machine. This enables or supports a particularly compact construction and energy-efficient production of a water-fuel emulsion.

The term "rotor-stator emulsifying device or fluid flow machine" is preferably to be understood as a machine or device that is designed to transfer mechanical work to a fluid or to withdraw it from a fluid. Consequently, a rotor-stator emulsifying device or fluid flow machine is preferably embodied either as a work machine or fluid-flow work machine or as a prime mover or fluid-flow power machine.

In terms of the present invention, a rotor-stator emulsifying device or fluid flow machine preferably has or forms a flow channel, preferably wherein a fluid can flow preferably continuously through the flow channel.

Preferably, a rotor-stator emulsifying device or fluid flow machine in terms of the present invention has a shaft and a housing, preferably wherein the shaft is at least partially arranged in the housing and rotates about an axis of rotation during operation. The housing preferably forms or delimits the flow channel or a portion thereof.

A rotor-stator emulsifying device or fluid flow machine preferably has at least one running wheel or rotor with a plurality of blades and/or teeth and/or channels, gaps, or other passages, said channels, gaps or other passages preferably extending radially and/or axially through the running wheel, preferably wherein the running wheel is connected in a form-fitting, force-fitting and/or bonded manner to the shaft and/or forms a stage of the rotor-stator emulsifying device or fluid flow machine.

In the following, the term "running wheel" is always preferably used synonymously with the expression "rotor of the rotor-stator emulsifying device." These terms are therefore preferably interchangeable.

Preferably, the blades and/or teeth of a rotor-stator emulsifying device or fluid flow machine are elongate, planar and/or plate-like and/or designed to withdraw work from a fluid flowing past or to transfer work to a fluid flowing past A rotor-stator emulsifying device or fluid flow machine according to the present invention is especially preferably designed to transfer shear forces to a fluid or an emulsion, in particular a water-fuel emulsion, particularly in such a way that a preferably homogeneous mixture of water in the fuel and/or a small average droplet size of the water in the fuel is achieved.

The term "emulsion" is preferably to be understood as meaning a mixture of at least two fluids. Preferably, an emulsion comprises a first fluid, such as fuel, as the internal phase and a second fluid, such as water, as the external phase. A water-fuel emulsion in terms of the present invention is therefore a mixture of water and fuel, such as diesel, wherein the average droplet size or the average droplet diameter of the water droplets is less than 10 μm, especially preferably less than 5 μm, particularly less than 1 μm. However, a water-fuel emulsion may also consist of other fluids and/or contain other fluids or substances, for example an emulsifier. In particular, an alcohol may be used in addition to or as an alternative to water.

The proposed emulsifying device preferably has a plurality of stages and/or running wheels, the running wheels preferably having a plurality of blades and/or teeth and being preferably connected to a shaft. In particular, the emulsifying device has a first stage or pre-emulsifying stage and a second stage or fine emulsifying stage. In the fine emulsifying stage, the water-fuel emulsion can be further homogenized so that the average droplet size of the emulsion produced at the pre-emulsifying stage is reduced. This enables a particularly homogeneous water-fuel emulsion having a small average water droplet size.

According to another aspect of the present invention that can also be realized independently, the shaft of the emulsifying device can be driven in a contactless manner and/or magnetically and/or the shaft has a permanent magnet that preferably is or can be flowed around at least partially or the shaft is connected to such a permanent magnet. This enables a particularly low-maintenance, stable and/or leak-free construction of the emulsifying device.

The emulsifying device preferably has a drive, particularly an electric drive, such as an electric motor, particularly a direct-current motor or three-phase motor. Especially preferably, the drive is designed to transmit a torque contact-free to the shaft, preferably by means of magnetic coupling.

According to another aspect of the present invention that can also be realized independently, the housing is at least partially made of fiber composite material, particularly carbon fiber-reinforced plastic, and/or it is embodied as an insulator. This enables a particularly light and stable construction to be achieved that withstands pressures of more than 100 MPa. Moreover, this prevents eddy currents from being induced by the preferably electric drive into the housing and thereby reducing the efficiency of the drive.

According to another aspect of the present invention that can also be realized independently, the housing of the emulsifying device has a preferably circumferential guide apparatus having a plurality of guide channels or forms such a guide apparatus, preferably wherein the guide apparatus protrudes into the flow channel and/or is arranged directly before one of the stages, particularly the fine emulsifying stage. Especially preferably, the guide channels are embodied so as to guide the fluid or the water-fuel emulsion in a targeted manner to a subsequent or downstream stage, particularly the fine emulsifying stage. In this way, a more homogeneous mixture of the water-fuel emulsion is achieved.

The guide apparatus may be a stator of the rotor-stator emulsifying device. The terms "guide apparatus" and "stator of the rotor-stator emulsifying device" are therefore preferably synonymous and/or interchangeable.

In a preferred embodiment, the channels are formed by openings, passages, and/or boreholes. Alternatively or in addition, however, they may also be passages, gaps, notches, indentations, recesses, interstices, or the like. These can correspond to or overlap at least intermittently with passages, gaps, notches, indentations, recesses, interstices, or the like of the running wheel.

The guide apparatus may comprise blades and/or teeth and/or channels, gaps, or other passages through the guide apparatus, preferably extending radially and/or axially, preferably wherein the guide apparatus is connected in a form-fitting, force-fitting, and/or bonded manner to the housing or a portion thereof or is integrally formed therewith and/or forms a stage of the rotor-stator emulsifying device or fluid flow machine, preferably together or in cooperation with an associated running wheel.

The construction of the guide apparatus can be similar at least in some portions, particularly in adjacent portions, to the construction of the running wheel, correspond thereto, or vice versa.

The proposed emulsifying system preferably has an emulsifying device for producing a water-fuel emulsion and an injection nozzle for injecting the water-fuel emulsion into a combustion chamber of an internal combustion engine.

The term "injection nozzle" is preferably to be understood as a device that is designed to distribute or atomize or nebulize fuel or a water-fuel emulsion or to form an aerosol with the water-fuel emulsion in this or another manner and/or guide it into an associated combustion chamber. An injection nozzle according to the present invention preferably has a fluid connection for fuel or a water-fuel emulsion, an electrical connection to a control device, a compression spring, a nozzle body, and/or a nozzle needle. Optionally, an injection nozzle has a preferably electric (piezoelectric) actuator for actuating the nozzle needle. Preferably, the nozzle needle can be opened as a function of the fuel or emulsion pressure, preferably such that the fuel or the emulsion is injected into a combustion chamber.

According to an aspect of the present invention that can also be realized independently, the emulsifying device is connected or connectable directly or immediately to the injection nozzle—preferably in a rigid manner—and/or integrated into the injection nozzle or the inlet thereof. Especially preferably, the emulsifying device and the injection nozzle together form an at least substantially fixed and/or rigid and/or integrally formed assembly or structural unit. In this way, the distance between the emulsifying device and the injection nozzle is minimized, thereby reducing any flow losses, enabling dynamic adaptation of the water-fuel ratio, and/or counteracting segregation of the emulsion. Furthermore, by virtue of the compact construction or the smaller volume of the emulsifying system of preferably less than 20 ml, particularly less than 10 ml, the amount of fuel required for rinsing the emulsifying system can be reduced.

In the proposed emulsifying method for producing a water-fuel emulsion, water and fuel are fed—preferably separately from one another and/or under pressure—to a preferably multi-stage rotor-stator emulsifying device or fluid flow machine in order to produce the water-fuel emulsion. Corresponding advantages are achieved in this way.

According to another aspect of the present invention that can also be realized independently, in the proposed emulsifying method, water and fuel are premixed in a first stage or pre-emulsifying stage of a rotor-stator emulsifying device or fluid flow machine and subsequently fed via a preferably circumferential guide apparatus having a plurality of guide channels for guiding the flow to a second stage or fine emulsifying stage of the rotor-stator emulsifying device or fluid flow machine. The second stage preferably reduces an average droplet size of the water. Such a multi-stage emulsifying method results in a particularly homogeneous water-fuel emulsion.

According to another aspect of the present invention that can also be realized independently, a preferably multi-stage rotor-stator emulsifying device or fluid flow machine is used to produce a water-fuel emulsion for an internal combustion engine. Corresponding advantages are achieved in this way.

In principle, the abovementioned aspects and features of the present invention as well as the aspects and features of the present invention that follow from the claims and the following description can be implemented independently of one another, but also in any desired combination or order.

BRIEF DESCRIPTION OF THE DRAWINGS

Other aspects, advantages, features, and characteristics of the present invention follow from the claims and the following description of preferred embodiments with reference to the drawing.

DETAILED DESCRIPTION

In the partially not-to-scale, merely schematic figures, the same reference symbols are used for same, congeneric, or similar components, with it being possible for corresponding or comparable characteristics and advantages to be achieved even if a repeated description is omitted.

Figure 1:
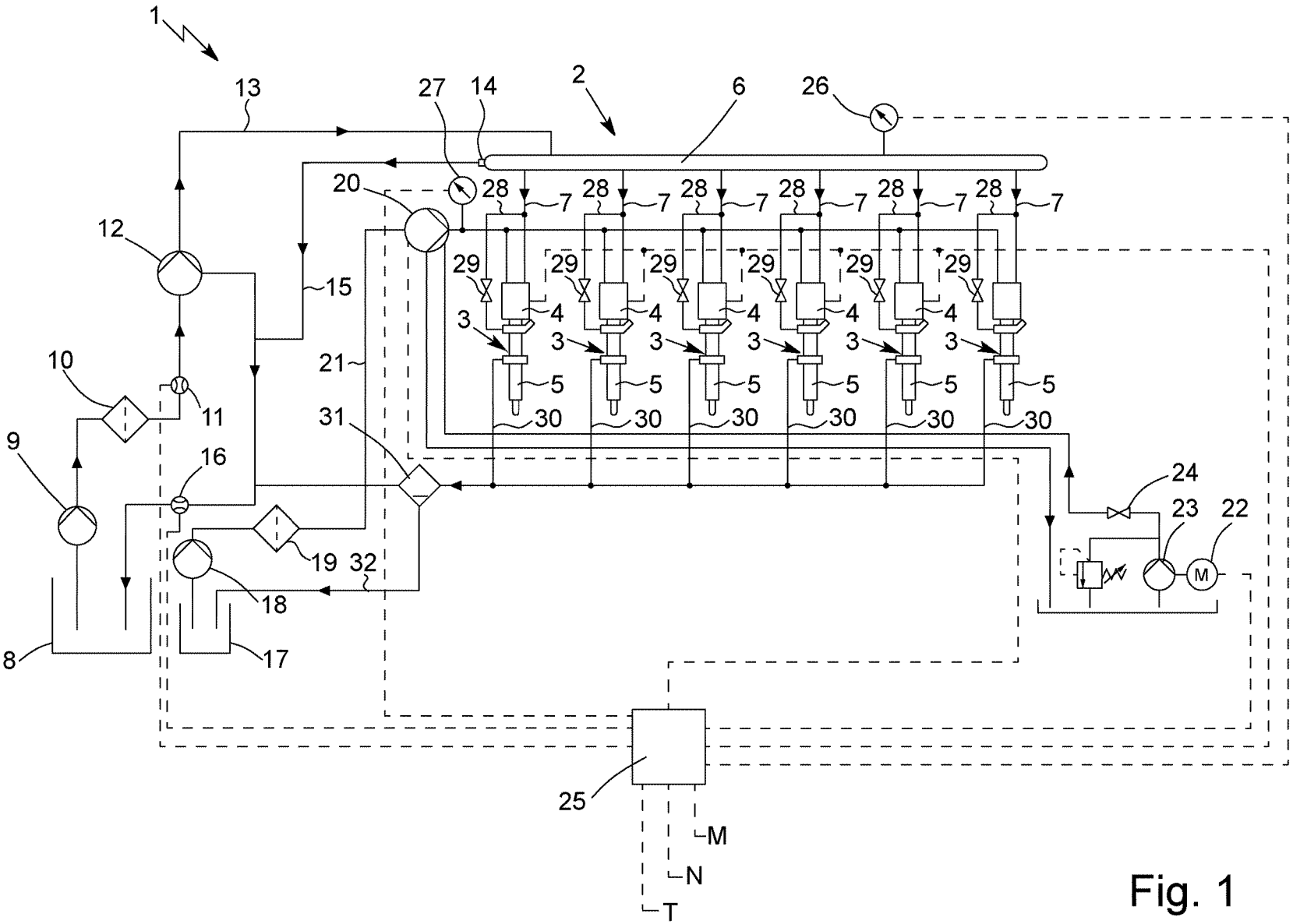
FIG. 1 shows a schematic representation of a proposed internal combustion engine with a proposed injection system according to a first embodiment.

FIG. 1 shows a schematic representation of a proposed internal combustion engine 1 with the proposed injection system 2.

The internal combustion engine 1 and/or the injection system 2 preferably has at least one emulsifying system 3.

The injection system 2 is preferably designed to inject fuel and/or water into one or more combustion chambers (not shown) of the internal combustion engine 1, preferably under pressure, particularly at greater than 50 MPa or 100 MPa.

The emulsifying system 3 is preferably designed to mix or emulsify water and fuel, particularly diesel, and/or to create or produce a water-fuel emulsion or a water-diesel emulsion, from water and fuel, particularly diesel. In principle, however, other fluids can also be emulsified with one another by means of the emulsifying system 3.

In the depicted embodiment, the internal combustion engine 1 and/or the injection system 2 has a plurality of—in this case six—emulsifying systems 3, preferably with one emulsifying system 3, respectively, being associated or associable with one cylinder (not shown) of the internal combustion engine 1 and/or being fluidly connected or connectable to one cylinder and/or combustion chamber, of the internal combustion engine 1.

The internal combustion engine 1 and/or the injection system 2 and/or the emulsifying system 3 preferably has an emulsifying device 4 and/or an injection nozzle or an injector 5.

The internal combustion engine 1 and/or the injection system 2 preferably has a fuel rail or diesel rail or a common rail 6, preferably wherein a plurality of emulsifying systems 3, emulsifying devices 4, and/or injection nozzles 5 are—preferably each individually—fluidly connected or connectable to the common rail 6, preferably each via a high-pressure or injection line 7.

The emulsifying device 4 is preferably arranged between the common rail 6 and the injection nozzle 5.

In the following, the schematic structure of the internal combustion engine 1 and the injection system 2 will first be described with reference to FIGS. 1 and 2 before the emulsifying system 3 and the emulsifying device 4 are explained in greater detail.

The internal combustion engine 1 and/or the injection system 2 preferably has a fuel tank 8, a fuel precompression pump 9, a fuel filter 10, a fuel meter 11, particularly a fuel volume meter, and/or a high-pressure fuel pump 12, preferably on a (common) fuel supply line 13.

Preferably, the high-pressure fuel pump 12 and/or the common rail 6 has/have a high-pressure regulator 14 and/or a fuel return line 15.

The fuel return line 15 preferably connects the common rail 5, the fuel precompression pump 9, and/or high-pressure fuel pump 12 to the fuel tank 8, the fuel return line 15 preferably having a (an additional) fuel meter 16.

Preferably, the injection system 2 and/or the emulsifying system 3 and/or the emulsifying device 4 is fluidly connected via the fuel supply line 13 to the fuel tank 8.

In particular, the emulsifying system 3 and/or the emulsifying device 4 can be supplied with fuel, particularly diesel, and another component—water, in this case—preferably in order to produce a water-fuel emulsion.

The internal combustion engine 1 and/or the injection system 2 preferably has a water tank 17, a water precompression pump 18, a water filter 19, and/or a high-pressure water pump or metering unit 20, preferably on a (common) water supply line 21.

Preferably, the emulsifying system 3 and/or the emulsifying device 4 is connected via the water supply line 21 to the water tank 17 and/or can be supplied with water.

The internal combustion engine 1 and/or the injection system 2 and/or the emulsifying system 3, the high-pressure fuel pump 12 and/or high-pressure water pump 20 preferably has/have a particularly hydraulic drive 22, the drive 22 preferably having a pump 23 and/or a valve 24, particularly for pressurizing with or supplying water or another hydraulic fluid, preferably at variable or adjustable pressure.

The internal combustion engine 1 and/or the injection system 2 preferably has a control unit 25, the control unit 25 being preferably designed to control or feedback control the composition of the water-fuel emulsion or the water component in the water-fuel emulsion, preferably as a function of at least one operating parameter and/or engine operation, especially preferably as a function of the engine load M, engine speed N, and/or cooling-water temperature T.

Preferably, the water component in the water-fuel emulsion can be altered, varied and/or adapted as a function of the engine operating point.

Using dashed lines, FIG. 1 shows the corresponding preferred and/or optional signal connections, control lines, or the like of the control unit 25 with the corresponding components.

Preferably, the controller 25 is or can be electrically connected to the injection system 2, the emulsifying system 3, the emulsifying device 4, the injector 5, the common rail 6, the fuel precompression pump 9, the fuel meter 11, the high-pressure fuel pump 12, the fuel meter 16, the water precompression pump 18, the high-pressure water pump 20, and/or the drive 22.

The internal combustion engine 1 and/or the injection system 2 preferably has at least one pressure sensor 26, 27 and/or at least one pressure sensor 26, 27 is integrated into the fuel supply line 13 and/or water supply line 21, the control device 25 being preferably electrically connected to the pressure sensor 26, 27 and/or measurement signals of the fuel pressure and/or of the water pressure can be transmitted to the control device 25.

In the depicted embodiment, the internal combustion engine 1 and/or the injection system 2 preferably has a fuel pressure sensor 26 and/or a water pressure sensor 27.

Preferably, the fuel pressure sensor 26 is arranged in the common rail 6 and/or designed to measure the pressure of the fuel in the common rail 6.

Preferably, the water pressure sensor 27 is arranged immediately after or downstream of the high-pressure water pump 20 and/or designed to measure the water pressure immediately before the emulsifying system 3.

As already explained at the outset, the internal combustion engine 1 and/or the injection system 2 preferably has a plurality of emulsifying systems 3, emulsifying devices 4 and/or injection nozzles 5.

Preferably, the emulsifying systems 3 and/or emulsifying devices 4 and/or injection nozzles 5 are connected in parallel to the fuel supply line 13 and/or the common rail 6 and/or the water supply line 21 and/or are or can be supplied in parallel with fuel and/or water.

In the depicted embodiment, each cylinder and/or each injection nozzle 5 is preferably associated with a separate or its own emulsifying device 4. However, constructive solutions are also possible in which a plurality of cylinders or injection nozzles 5 are connected to a (common) emulsifying device 4, as FIG. 2 illustrates.

The internal combustion engine 1 and/or the injection system 2 and/or the emulsification system 3 preferably has a bypass line or purge line 28 and/or a bypass valve or purge valve 29, preferably wherein fuel can be fed via the bypass line 28 and bypass valve 29 from the fuel supply line 13 and/or the common rail 6 directly or immediately to the injection nozzle 5 and/or past the emulsifying device 4.

Especially preferably, the bypass line 28 is connected in parallel to the emulsifying device 4 and/or the bypass line 28 connects the injection nozzle 5 directly to the common rail 6.

The bypass line 28 and/or the bypass valve 29 can be preferably used to flush the injection nozzle 5 with fuel and/or to ensure an at least substantially loss-free supply of the injection nozzle 5 with fuel when the emulsifying device 4 is deactivated. It is thus possible for the internal combustion engine 1 and/or the injection system 2 to be supplied with fuel at least substantially without interruption and/or loss even with a deactivated and/or defective emulsifying device 4.

The internal combustion engine 1 and/or the injection system 2 preferably has a leakage line 30 and/or a leakage line 30 is connected to the emulsifying system 3, particularly to the injection nozzle 5. It is preferably possible to use the leakage line 30 to flush the emulsifying system 3, particularly the emulsifying device 4 and/or the injection nozzle 5, with fuel and/or to flush residual quantities of the water-fuel emulsions from the emulsifying system 3, particularly from the emulsifying device 4 or the injection nozzle 5, preferably without fuel getting into an associated cylinder.

The leakage line 30 is preferably connected to a water separator and/or fuel separator 31 and/or connects the injection nozzle 5 to a water separator and/or fuel separator 31.

The water separator 31 is preferably designed to separate fuel and water of the water-fuel emulsion from one another and/or to separate off water and/or fuel.

The fuel that is separated off by means of the water separator 31 can be preferably fed to the fuel return line 15 and/or fuel tank 8.

The water that is separated off by means of the water separator 31 can be preferably fed via a corresponding water return line 32 to the water tank 17.

Figure 2:
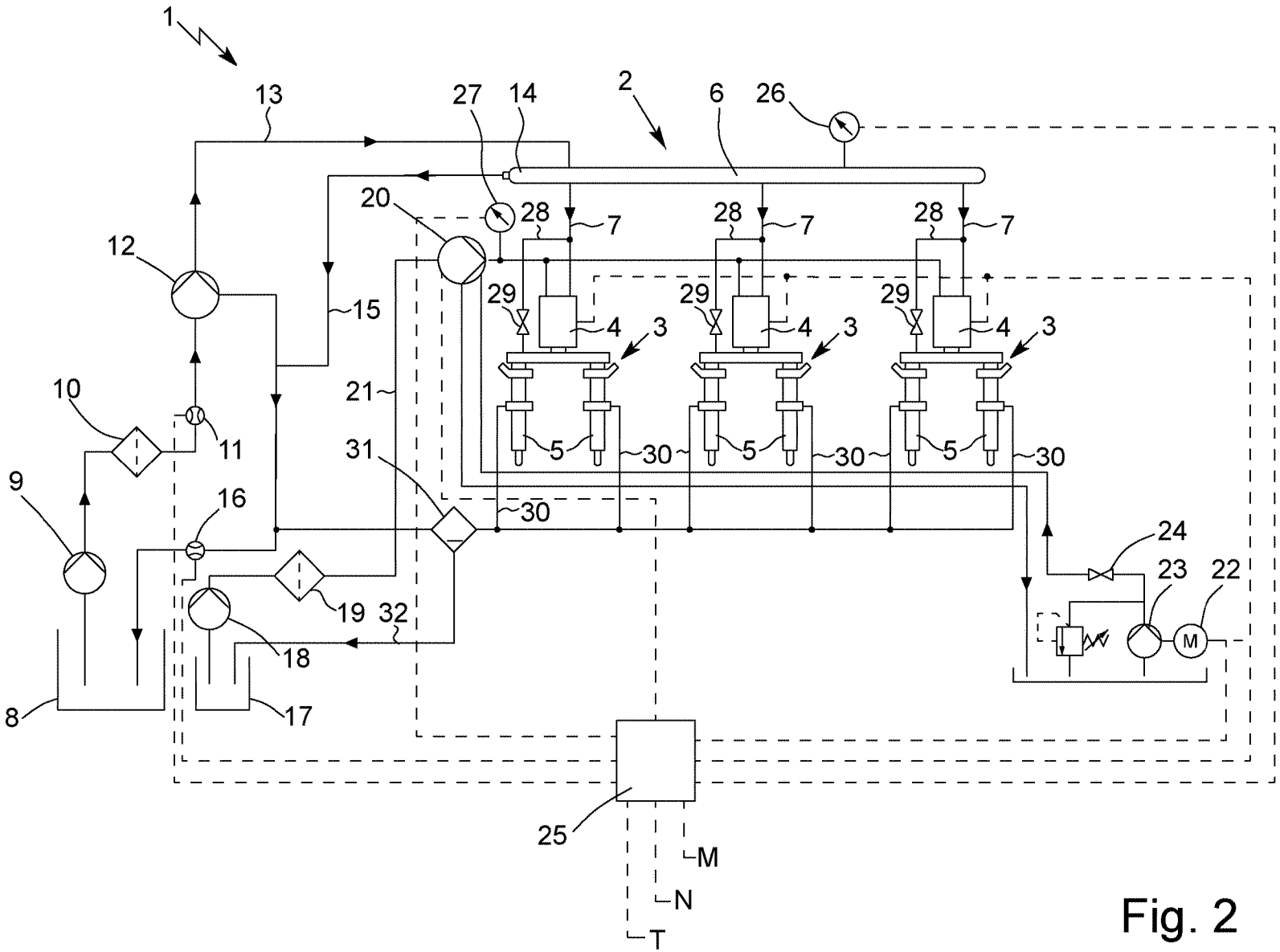
FIG. 2 shows a schematic representation of a proposed internal combustion engine with a proposed injection system according to a second embodiment.

FIG. 2 shows a schematic view of a proposed internal combustion engine 1 according to an alternative embodiment in which the injection nozzles 5 are connected in pairs to a common emulsifying device 4 and/or an emulsifying system 3 has a plurality of injection nozzles 5 (two in this case). The further remarks and explanations regarding the first embodiment according to FIG. 1 apply accordingly or in addition.

Figure 3:
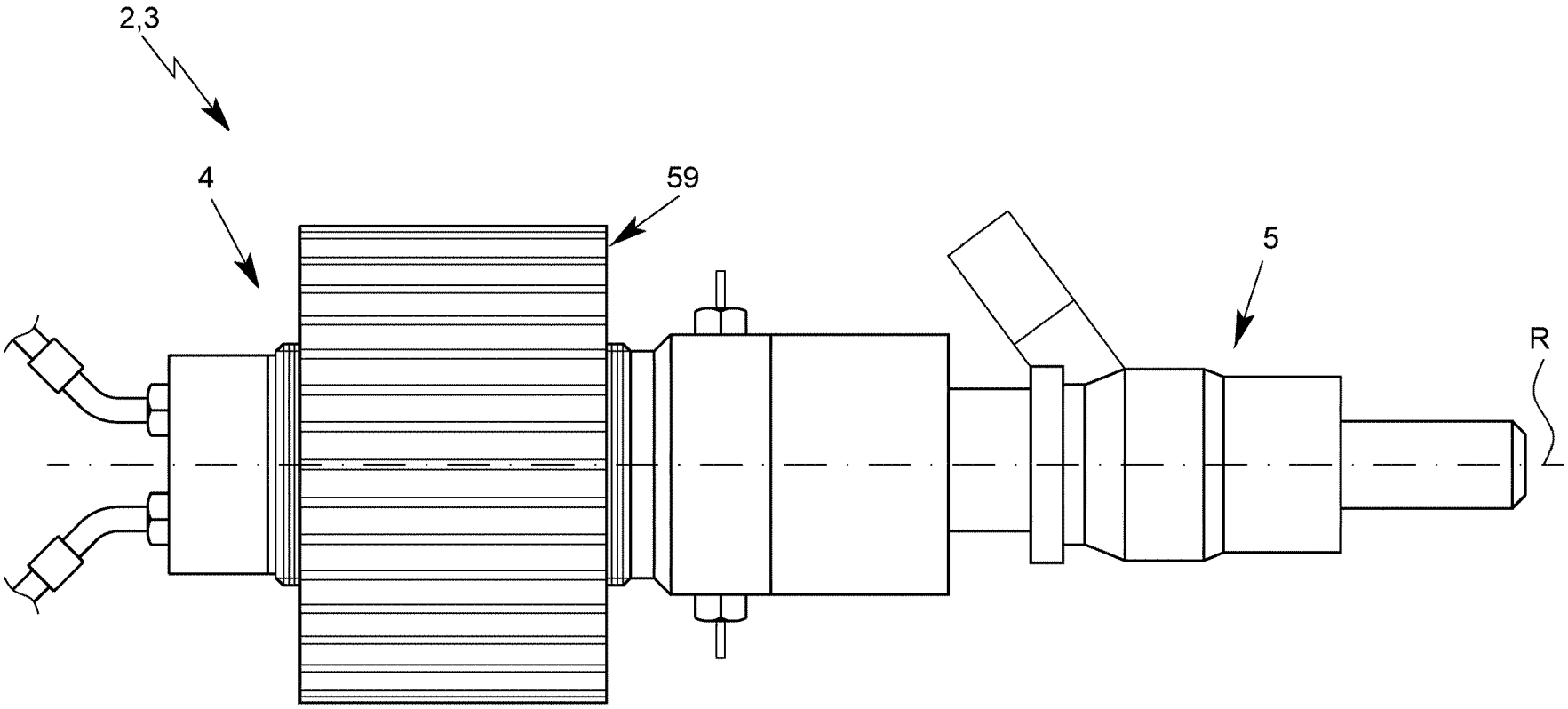
FIG. 3 shows a schematic view of a proposed emulsifying system according to a first embodiment.
Figure 4:
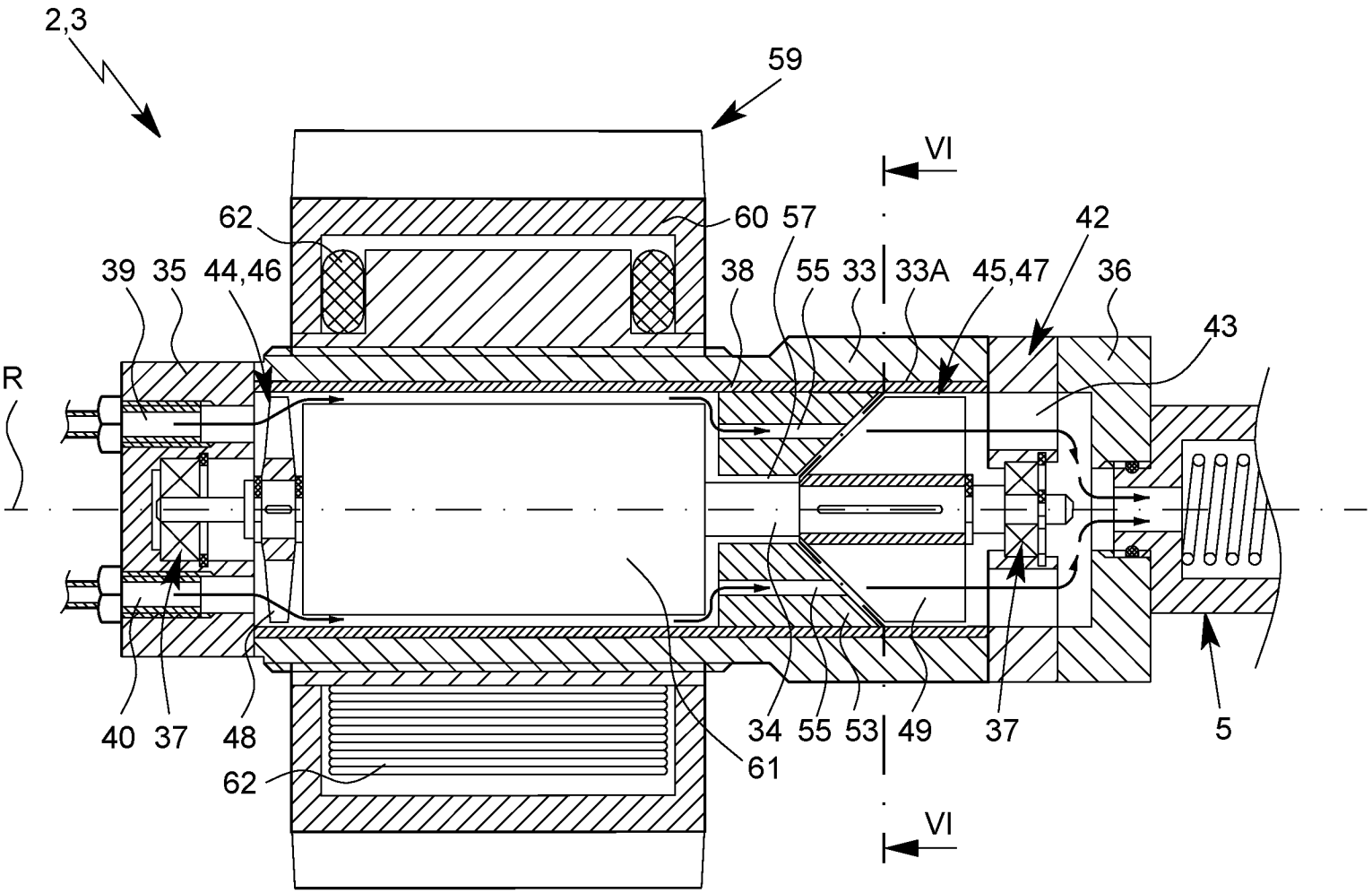
FIG. 4 shows a schematic section of the emulsifying system according to FIG. 3.

FIG. 3 shows the proposed emulsifying system 3 with a proposed emulsifying device 4 and an injection nozzle 5 in a perspective view. FIG. 4 shows the emulsifying device 4 as well as partially the injection nozzle 5 in a schematic section.

The emulsifying device 4 preferably has a housing 33 and a shaft 34, the shaft 34 being preferably arranged at least partially in the housing 33. In the depicted embodiment, the shaft 34 is arranged completely in the housing 33.

The housing 33 is preferably elongate and/or cylindrical or embodied like or as a hollow cylinder. Especially preferably, the housing 33 is rotationally symmetrical.

The housing 33 preferably delimits or defines, radially and/or laterally, a flow channel and/or emulsifying chamber, preferably wherein in the flow channel and/or emulsifying chamber the water-fuel emulsion is produced and/or water and fuel is mixed or emulsified.

The flow channel and/or emulsifying chamber is preferably elongate and/or cylindrical.

The shaft 34 is preferably arranged centrally in the housing 33 and/or in the emulsifying chamber.

The shaft 34 can be preferably rotated about a rotation axis R. Especially preferably, the longitudinal axis or rotation axis R of the shaft 34 corresponds to the longitudinal axis or axis of symmetry of the housing 33 and/or of the emulsifying chamber.

The emulsifying device 4 and/or the housing 33 can be preferably flowed through at least substantially axially. In particular, the emulsifying device 4 and/or the housing 33 are designed to be open at the axial ends, preferably such that water and fuel can flow axially into the emulsifying device 4 and/or the housing 33 and can flow out of the emulsifying device 4 and/or the housing 33, preferably as an emulsion, axially and/or on another, preferably opposing side.

It is very especially preferred that the emulsifying device 4 and/or the housing 33 have an inline construction.

Preferably, the axial ends of the housing 33 are each closed or can each be closed by a lid 35, 36, particularly in a pressure-proof manner.

Preferably, the emulsifying device 4 has a first lid 35 and a second lid 36, the first lid 35 and/or the second lid 36 preferably being connected or connectable in a form-fitting, force-fitting and/or bonded manner, particularly by gluing, to the housing 33.

Preferably, the shaft 34 is mounted axially and/or radially in or by means of the first lid 35 and/or the second lid 36.

Especially preferably, the shaft 34 is rotatably supported by means of a bearing 37 in the housing 33, particularly in the first lid 35 and/or second lid 36.

The bearing 37 is preferably embodied as a slide bearing, with the shaft 34 and/or the bearing 37 in particular being lubricated by means of the water and/or fuel and/or the emulsion. However, other structural solutions are also possible here, particularly in which the bearing 37 is embodied as an antifriction bearing.

In the depicted first embodiment, the bearing 37 of the emulsifying device 4 is preferably embodied as a fixed-floating bearing. However, it is also possible for the bearing 37 to be formed as a support bearing and/or for the shaft 34 to be supported in a floating manner.

The housing 33, the first lid 35, and/or the second lid 36 is/are made at least in part with or from fiber composite material, particularly carbon fiber-reinforced plastic. This enables or supports an especially stable and light construction of the emulsifying device 4.

The housing 33 or the housing wall is preferably multi-layered or multi-ply, particularly in the radial direction. In particular, the housing 33 has a plurality of material layers, each of the material layers being preferably integrally formed.

The emulsifying device 4 and/or the housing 33 preferably has a reinforcement and/or coating 38 on an inner side 33A and/or the emulsifying device 4 and/or the housing 33 is coated and/or reinforced on the inside or on an inner side 33A, preferably by means of a reinforcement and/or coating 38.

The coating 38 is preferably made of or formed by metal, particularly aluminum, or paint, plastic, or a resin. In this way, the stability, durability, and/or tightness of the emulsifying device 4 and/or housing 33 is achieved or increased, particularly for pressures above 5 MPa, 10 MPa, 15 MPa, or 50 MPa.

In the depicted embodiment, the housing 33 is formed by a sleeve, particularly an aluminum sleeve, and a jacket, in particular a fiber composite jacket, preferably wherein the sleeve and the jacket each are integrally formed. Especially preferably, the sleeve is arranged on a side facing the emulsifying chamber and/or the jacket surrounds the sleeve on the outside and/or on a side facing away from the emulsifying chamber. Very especially preferably, the sleeve forms the reinforcement or coating 38 and/or the sleeve has the reinforcement or coating 38.

The emulsifying system 3 and/or the emulsifying device 4 preferably has an inlet Especially preferably, the emulsifying system 3 and/or the emulsifying device 4 has a fuel inlet 39 and a water inlet 40, preferably wherein fuel can be fed via the fuel inlet 39 and/or water can be fed via the water inlet 40 to the emulsifying system 3 and/or the emulsifying device 4, particularly to the emulsifying chamber. However, constructive solutions are also possible in which the emulsifying system 3 and/or the emulsifying device 4 has a common inlet for fuel and water and/or water and fuel can be fed together via a common inlet to the emulsifying system 3 and/or the emulsifying device 4.

Preferably, the fuel inlet 39 and the water inlet 40 are formed by the housing 33, particularly the first lid 35.

In particular, fuel and/or water can be fed to the emulsifying device 4 and/or to the emulsifying chamber, at least substantially axially and/or parallel to the rotation axis R or longitudinal or symmetrical axis of the housing 33 and/or emulsifying chamber.

The emulsifying system 3 and/or the emulsifying device 4 is preferably connected or connectable to the common rail 6 and/or the injection line 7 via the fuel inlet 39 and to the water supply line 21 and/or the high-pressure water pump 20 via the water inlet 40.

As already explained at the outset, the emulsifying device 4 is connected or connectable preferably immediately or directly to at least one injection nozzle 5, particularly fluidly and/or mechanically.

Especially preferably, the emulsifying device 4 is or can be connected in a form-fitting, force-fitting, and/or bonded manner to an associated injection nozzle 5, particularly by screwing, preferably directly and/or rigidly.

Preferably, the emulsifying device 4 and at least one injection nozzle 5 together form a fixed and/or rigid assembly or structural unit.

Preferably, the emulsifying device 4 can be screwed or plugged immediately or directly onto an injection nozzle 5. This enables or supports easy mounting and/or dismounting of the emulsifying device 4.

The emulsifying device 4 is preferably arranged so as to be coaxial with the associated injection nozzle 5 or a fuel flange thereof and/or the emulsifying device 4 and the injection nozzle 5 and/or the fuel flange of the emulsifying system 3 have a common longitudinal axis. However, other structural solutions are also possible here.

Preferably, the emulsifying device 4 and/or the housing 33 have an outlet 41, preferably wherein the water-fuel emulsion can be supplied to the injection nozzle 5 via the outlet 41 and/or the second lid 36 has or forms the outlet 41.

The outlet 41 is preferably arranged centrally in the second lid 36 and/or coaxially with the rotation axis R or axis of symmetry of the rotationally symmetrical emulsifying chamber.

The injection nozzle 5 is or can be preferably connected immediately or directly in a fluid manner to the outlet 41. Very especially preferably, the injection nozzle 5 can be screwed into or onto the outlet 41. However, other structural solutions are also possible here, particularly in which the emulsifying device 4 is integrated into the injection nozzle 5 and/or at least partially arranged within the injection nozzle 5 or formed by the injection nozzle 5. In particular, the emulsifying device 4 can be arranged in an inlet of the injection nozzle 5 and/or can be integrally formed with the injection nozzle 5. In one variant, the housing 33 is securely connected to a housing of the injection nozzle 5 or integrally formed therewith.

Preferably, the emulsifying device 4 has a bearing 37 that is or can be flowed around at least partially and/or at least one support of the bearing 37, here the fixed bearing, can be flowed around.

Preferably, the emulsifying device 4 has a bearing star 42, in particular the bearing star 42—starting from the housing 33—protruding into the emulsifying chamber and/or being connected to the housing 33 and/or one of the lids 35, 36.

The bearing star 42 preferably has a plurality of radial supports or struts 43, the radial supports 43 preferably being embodied so as to receive a bearing, particularly a slide bearing, and/or to form a bearing, particularly a slide bearing, for the shaft 34. Other solutions are also possible here, however.

As already explained at the outset, the emulsifying device 4 is preferably embodied as a rotor-stator emulsifying device or fluid flow machine or fluid-flow work machine. Preferably, the emulsifying device 4 is exclusively designed to emulsify water and fuel or to produce a water-fuel emulsion. However, solutions are also possible in which the emulsifying device 4 (additionally) has a pumping function or is designed as a pump and/or is designed to convey or pump water and fuel and/or the water-fuel emulsion, preferably to the injection nozzle 5. Very especially preferably, the emulsifying device 4 is designed to reduce flow loss, particularly pressure losses, of the flow during the creation of the emulsion.

The emulsifying device 4 is preferably embodied as a multi-stage, here two-stage, rotor-stator emulsifying device or fluid flow machine, and/or the emulsifying device 4 has a plurality of, here two, stages or emulsifying stages.

Preferably, the emulsifying device 4 comprises a first stage 44 and a second stage 45, preferably wherein the first stage 44 comprises or is formed by a first running wheel 46 and the second stage 45 comprises or is formed by a second running wheel 47.

Optionally, the first stage 44 and/or the second stage 45 (each) comprise(s) a guide wheel (not shown), the guide wheel preferably being arranged just before or upstream of the or just after or downstream from the first running wheel 46 and/or second running wheel 47.

The first and/or second running wheel 46 or 47 is preferably connected to the shaft 34 in a form-fitting, force-fitting, and/or bonded manner, in particular by means of feather key, by pressing and/or by gluing, preferably such that a torque from the shaft 34 can be transferred to the first running wheel 46 and/or second running wheel 47 or vice versa.

Preferably, the optional guide wheel is connected in a form-fitting, force-fitting, and/or bonded manner to the housing 33.

The first and/or second running wheel 46, 47 preferably has a plurality of blades and/or teeth 48, 49, the blades and/or teeth 48, 49—starting from the shaft 34 and/or the rotation axis R—preferably protruding into the flow channel and/or emulsifying chamber radially.

The blades and/or teeth 48, 49 are preferably flat, elongate, plate-shaped, angular, and/or sharp-edged.

In particular, the stage 44, 45, the running wheel 46, 47 and/or the blades and/or teeth 48, 49 are designed to mix and/or to emulsify water and fuel with one another and/or to distribute and/or disintegrate the water in the fuel, preferably in order to produce a homogeneous water-fuel emulsion having a small average water droplet size, preferably of less than 1 μm or 0.5 μm.

Optionally, the stage 44, 45, the running wheel 46, 47 and/or the blades and/or teeth 48, 49 are designed to convey water and fuel and/or to pump water and fuel toward the injection nozzle 5.

Figure 5:
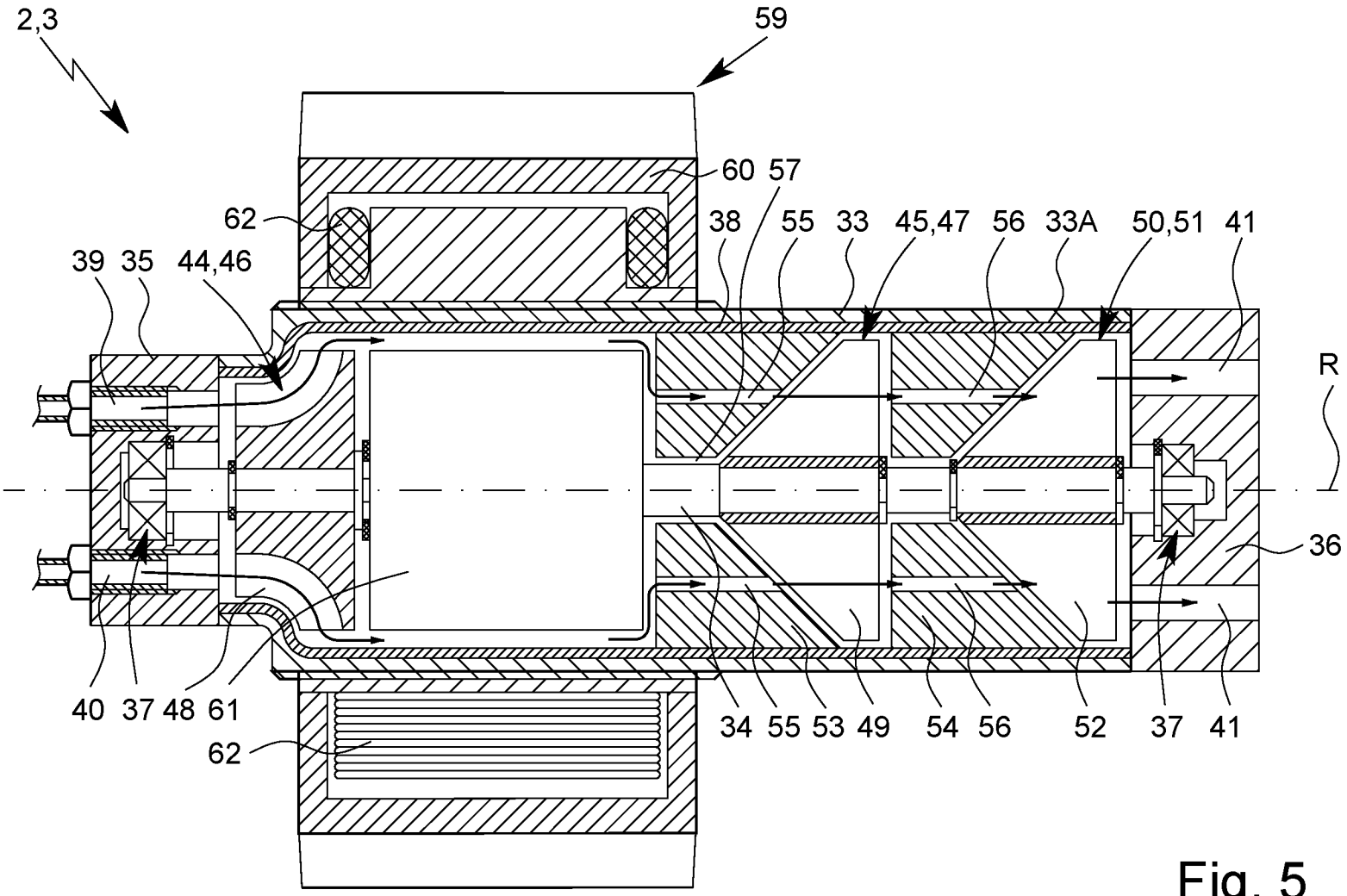
FIG. 5 shows a schematic section of a proposed emulsifying system according to a second embodiment.

The blades and/or teeth 48, 49 or the flat sides thereof are preferably trapezoidal, the upstream edges or sides of the blades and/or teeth 48, 49 preferably being arranged obliquely or at an inclination relative to the rotation axis R. In particular, the angle that is included in a longitudinal section, as shown in FIG. 4 or FIG. 5, between the front side or front edge of the blades and/or teeth 48, 49 and the rotation axis R is less than 90° or 80°.

Preferably, the first stage 44 is embodied as a pre-emulsifying stage and the second stage 45 as a fine emulsifying stage.

In particular, the first stage 44 is embodied so as to intermix preferably separately inflowing water and fuel, and the second stage 45 is embodied so as to (further) homogenize the water-fuel emulsion produced by the first stage 44 and/or to (further) reduce the droplet size of the water in the fuel.

In the depicted embodiment, the first stage 44 and second stage 45 are preferably embodied as axial stages. Other solutions are also possible here, however, as FIG. 5 illustrates.

FIG. 5 shows the proposed emulsifying device 4 according to a second embodiment in which the first stage 44 is embodied as a radial or diagonal stage.

Especially preferably, water and fuel flow or the water-fuel emulsion flows into the first stage 44 in a manner that is at least substantially parallel to the rotation axis R. In the depicted example, the water-fuel emulsion emerges radially or at least substantially orthogonally to the rotation axis R from the first stage 44 or first running wheel 46.

Preferably, the housing 33 or a downstream guide wheel (not shown) is embodied so as to divert water and fuel or the water-fuel emulsion, preferably such that the water and the fuel or the water-fuel emulsion then flow or flows (again) through the emulsifying device 4 at least substantially parallel to the rotation axis R.

In the depicted second embodiment of the emulsifying device, the second stage 45 is preferably embodied as an axial stage and/or the water-fuel emulsion flows through the second stage 45 at least substantially axially or parallel to the rotation axis R. However, other structural solutions are also possible here, particularly in which the second stage 45 is (also) embodied as a radial or diagonal stage.

In the second embodiment, the emulsifying device has three stages or emulsifying stages, and/or the second stage 45 is followed by an additional, third stage 50.

Preferably, the third stage 50 has the same fundamental construction as the second stage 45. In particular, the third stage 50 has a running wheel 51 with a plurality of blades and/or teeth 52.

Optionally, the injection nozzle 5 forms the third stage 50 or an additional stage and/or an emulsifying stage of the emulsifying system 3. In particular, the injection nozzle 5 can be designed to (further) homogenize the water-fuel emulsion and/or to reduce the average droplet size of the water in the fuel.

The injection system 2 and/or the emulsifying system 3 and/or the emulsifying device 4 preferably has a (first) guide apparatus 53, the guide apparatus 53 preferably being designed to guide and/or deflect the flow or the water-fuel emulsion in the emulsifying chamber.

The guide apparatus 53 is preferably connected in a form-fitting, force-fitting, and/or bonded manner to the housing 33, formed integrally with the housing 33, in particular with the coating 38, and/or preferably protrudes into the flow channel and/or emulsifying chamber.

The guide apparatus 53 is preferably circumferential. The guide apparatus 53 preferably encloses the shaft 34 radially.

The guide apparatus 53 is preferably located immediately before or upstream from one of the stages 44, 45, 50 and/or embodied so as to apply a deflected or directed flow or water-fuel emulsion to a downstream running wheel 46, 47, 51.

In the first embodiment, the guide apparatus 53 is preferably arranged immediately before or upstream from the second stage 45 or second running wheel 47, and/or associated with the second stage 45.

In addition or alternatively, the first stage 44 has a (further) guide apparatus 53 and/or the guide apparatus 53 is arranged immediately before or upstream from the first stage 44 or first running wheel 46, and/or is associated with the first stage 44.

In the second embodiment shown in FIG. 5, the emulsifying device 4 has a second guide apparatus 54, the second guide apparatus 54 being preferably arranged immediately before or upstream from the third stage 50 or third running wheel 51, and/or being preferably associated with the third stage 50.

The guide apparatus 53, 54 preferably has a plurality of guide channels 55, 56, preferably wherein the guide apparatus 53, 54 can be flowed through by means of the guide channels 55, 56.

The guide apparatus 53, 54 preferably has more than two, preferably more than four or six, particularly more than eight or twelve, guide channels 55, 56.

In the depicted embodiments, the guide channels 55, 56 are preferably arranged at least substantially parallel to the rotation axis R. However, other constructive solutions are also possible here, particularly in which the guide channels 55, 56 run obliquely and/or in the direction of flow from the outside to the inside or from the inside to the outside.

Preferably, the guide channels 55, 56 are arranged in an at least substantially central manner in the guide apparatus 53, 54 and/or the guide channels 55, 56 lead to mid-height of the blades and/or teeth 49, 52 that are arranged downstream.

In particular, the flow and/or the water-fuel emulsion can be guided or deflected by the guide apparatus 53, 54 and/or the guide channels 55, 56 at least substantially centrally to the blades and/or teeth 49, 52 that are arranged downstream.

The guide apparatus 53, 54 is preferably adapted to the blade contour or geometry of the associated running wheel 46, 47, 51.

In particular, the distance between the guide apparatus 53, 54 and the blades and/or teeth 48, 52 that are arranged downstream remains at least substantially the same or constant over the radius of the emulsifying chamber.

The emulsifying device 4 preferably has a radial gap 57 between the guide apparatus 53, 54 and the shaft 34, preferably in such a way that the shaft 34 extends in a contactless manner through the guide apparatus 53, 54.

Preferably, water, fuel and/or the water-fuel emulsion is able to flow through the radial gap 57. However, other solutions are also possible here, particularly in which a preferably dynamic seal, in particular a shaft sealing ring, especially preferably an axial shaft sealing ring, is arranged between the guide apparatus 53, 54 and the shaft 34 and/or in which the flow and/or the water-fuel emulsion is able to flow only through the guide channels 55, 56.

Figure 6:
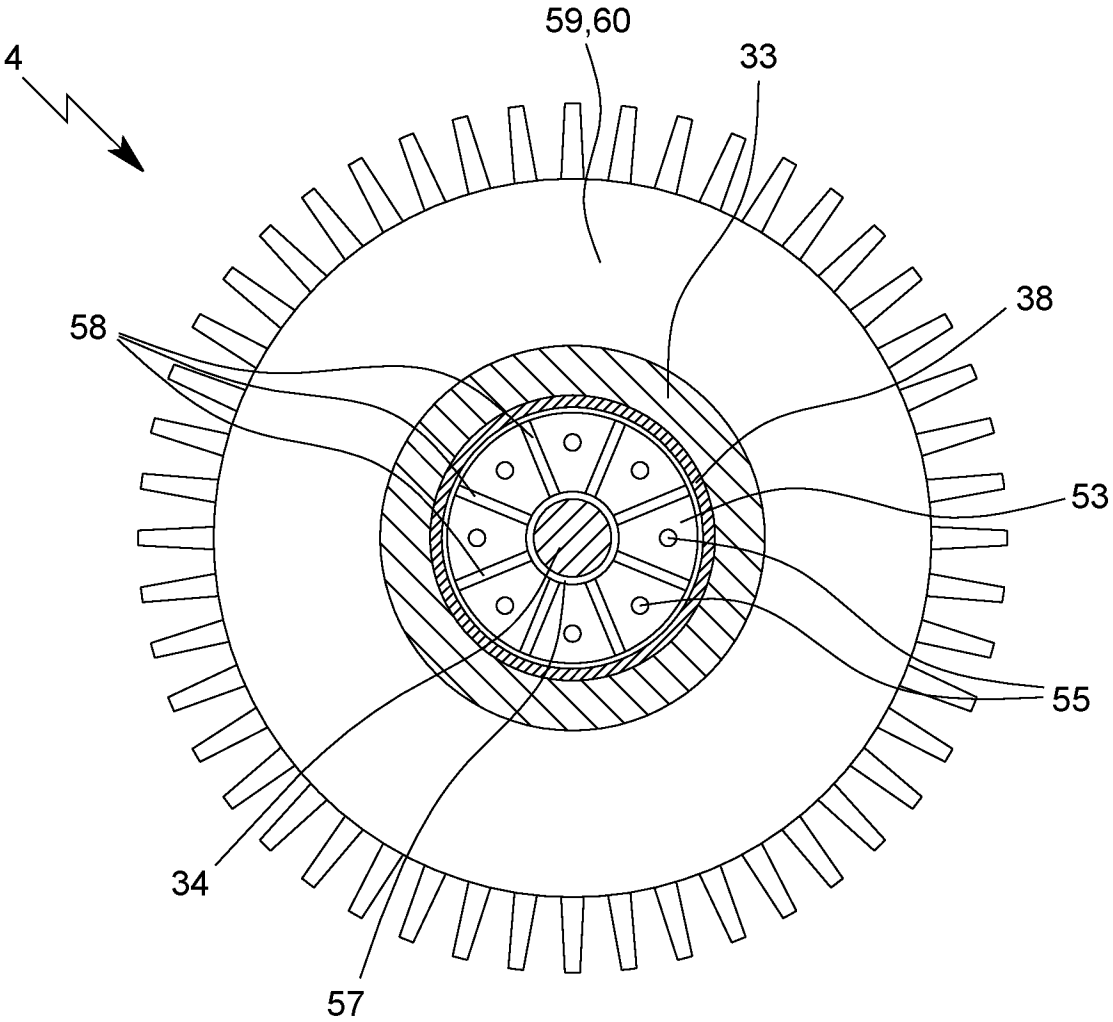
FIG. 6 shows a schematic cross section of the emulsifying system according to FIG. 5.

FIG. 6 shows the emulsifying device in a sectional view along the sectional line VI-VI (cf. FIG. 4).

On a side facing the associated running wheel 47, 51, the guide apparatus 53, 54 preferably has tear-off edges, vortices, shearing edges, or other surface structures that preferably have an emulsion-homogenizing effect. In the depicted example, a plurality of recesses 58 are provided, preferably wherein the recesses 58 are arranged in a star shape around the shaft 34 and/or extend from the shaft 34 to the housing 33.

The recesses 58 are preferably elongate and/or embodied as a groove. Preferably, the recesses 58 extend at least substantially radially.

Preferably, the recesses 58 are arranged between the guide channels 55, 56, in particular centrally.

In particular, the recesses 58 are designed to distribute the water-fuel emulsion flowing through the radial gap 57 radially outward and/or along the blades and/or teeth 48, 52. Moreover, the recesses 58 make it possible to achieve or support the circulation of the water-fuel emulsion in the emulsifying chamber. The recesses 58 can also be or form one-sided edges, vortex-forming bodies, or the like.

The emulsifying system 3 and/or the emulsifying device can be preferably driven in a contactless manner. In particular, a torque can be transferred to the shaft 34, preferably without contact.

Preferably, the emulsifying system 3 and/or the emulsifying device 4 has a drive 59, the drive 59 being preferably designed to drive the shaft 34 or to set it in rotation, preferably in a contactless manner.

The rotational speed of the shaft 34 that can be generated by the drive 59 (in revolutions per minute) is preferably greater than 5000 1/min or 10,000 1/min, especially preferably greater than 20,000 1/min or 30,000 1/min, in particular greater than 50,000 1/min or 80,000 1/min.

The drive 59 preferably has a stator 60 and a rotor 61, preferably wherein the stator 60 is connected in a form-fitting, force-fitting, and/or bonded manner to the housing 33 and/or the rotor 61 is connected in a form-fitting, force-fitting, and/or bonded manner to the shaft 34, and/or forms the shaft 34 or a portion thereof.

Preferably, the drive 59 is formed by a brushless electric motor, and the shaft 34 is electrically driven.

In particular, the drive 59 is embodied as a direct-current machine or as a three-phase machine, preferably as a—particularly brushless—three-phase synchronous machine or three-phase asynchronous machine. Especially preferably, it is a so-called brushless direct-current motor or electronically commutated three-phase synchronous machine. Other solutions are also possible here, however, particularly in which the drive 59 is embodied as a hydraulic or pneumatic drive 59, the drive 59 preferably transmitting torque to the shaft 34 via a magnetic coupling.

In another embodiment (not shown), the emulsifying system 3 and/or the emulsifying device 4 or the shaft 34 thereof, is or can be preferably driven passively and/or by the flow energy. In particular, constructive solutions are possible in which one of the stages 44, 45, 50, particularly a running wheel 46, 47, 51, is designed to draw energy from the flow, the fuel, the water and/or the water-fuel emulsion and/or to drive the shaft 34 or set it in rotation with flow energy. Advantageously, in this way an (active) driving of the emulsifying system 3 or emulsifying device 4 can be omitted.

The drive 59, particularly the stator 60, preferably has a plurality of coils 62, preferably wherein a magnetic field can be generated by means of the stator 60 or the coils 62. Especially preferably, a rotating magnetic field can be generated, preferably as a function of the frequency of a current, preferably of a three-phase current, and/or by sensor-controlled electronic commutation, for example.

The rotor 61 of the drive 59 is preferably a magnet, particularly a permanent magnet, and/or the rotor comprises a magnet, particularly permanent magnet, the rotor 61 preferably being rotatable in the magnetic field or by means of the magnetic field generated in the stator. Especially preferably, the rotor 61 or the permanent magnet thereof has at least one north pole and one south pole, respectively. However, the drive 59 can also be embodied as an asynchronous motor with coils or electromagnets in the rotor 61.

The rotor 61 and/or the shaft 34 preferably rotates synchronously or asynchronously with the magnetic field of the stator 60.

Preferably, the rotor 61 is or can be flowed around at least partially. Additionally or alternatively, the rotor 61 can be flowed through.

In particular, constructive solutions are possible in which the rotor 61 has boreholes or channels through which the water and/or the fuel and/or the water-fuel emulsion can flow.

Especially preferably, the surface of the rotor 61 is rough, structured, and/or provided with raised areas and/or depressions and/or designed to mix or emulsify the passing water and the passing fuel.

In an especially preferred embodiment (not shown), the rotor 61 has a plurality of blades and/or teeth or ribs and/or a plurality of blades and/or teeth are arranged on the surface of the rotor 61.

The drive 59 and/or rotor 61 is preferably arranged centrally in the emulsifying device 4 and/or the emulsifying chamber, and/or between the first stage 44 or the first running wheel 46 and the second stage 45 or the second running wheel 47. Other solutions are also possible here, however.

In the following, the proposed emulsifying method or the proposed use of a rotor-stator emulsifying device or fluid flow machine for producing a water-fuel emulsion is explained in greater detail.

The proposed emulsifying method is preferably carried out by means of the internal combustion engine 1, the injection system 2, the emulsifying system 3 and/or the emulsifying device 4.

The fuel is preferably taken from the fuel tank 8, preferably by means of the fuel precompression pump 9.

Preferably, the fuel is filtered in a fuel supply line 13, preferably by means of the fuel filter 10.

Preferably, the fuel is pressurized, preferably by means of the fuel precompression pump 9 and/or the high-pressure fuel pump 12, and fed to the common common rail 6.

The fuel pressure in the common rail 6 and/or in the emulsifying system 3 and/or in the emulsifying device 4, in particular in the fuel inlet 39, is preferably—at least temporarily or depending on the engine load—greater than 50 MPa, 100 MPa or 150 MPa, more preferably greater than 180 MPa or 200 MPa, particularly greater than 220 MPa.

The water is preferably taken from the water tank 17, preferably by means of the water precompression pump 18.

Preferably, the water is filtered or purified, preferably by means of the water filter 19.

Preferably, the water is pressurized, preferably by means of the water precompression pump 18 and/or the high-pressure water pump 20.

Preferably, the fuel and the water are equally pressurized and/or the pressure of the fuel immediately before the emulsifying system 3 and/or the emulsifying device 4 and/or in the fuel inlet 39 is equal to or slightly greater than the pressure of the water immediately before the emulsifying system 3 and/or the emulsifying device 4 and/or in the water inlet 40.

The fuel is preferably conducted past the emulsifying system 3 and/or emulsifying device 4, preferably by means of the bypass line 28 and/or the bypass valve 29, for example in the event of a defect in the emulsifying system 3 and/or emulsifying device 4.

Preferably, after the pressurization of the water and fuel, the water and the fuel are supplied to the emulsifying system 3 or emulsifying device 4, preferably separately from each other. Especially preferably, fuel is fed from the common rail 6 via the fuel inlet 39 and water is fed from the high-pressure water pump 20 via the water inlet 40 to the emulsifying system 3 or emulsifying device 4.

Alternatively, however, it is also possible for water and fuel to be fed together or collectively or via a common line to the emulsifying system 3 or emulsifying device 4.

Preferably, the fuel and the water are mixed or (pre-) emulsified in a first stage 44 and/or by means of a first running wheel 46 in the emulsifying device 4. Here, the fuel inlet 39 directs the fuel and/or the water inlet 40 directs the water onto the running wheel 46 preferably transversely, in particular in a manner at least substantially perpendicular to the plane of rotation of the running wheel 46.

Preferably, the emulsifying device 4 or the shaft 34 thereof is driven in a contactless manner and/or magnetically, preferably by means of the drive 59.

Preferably, the shaft 34 rotates (in revolutions per minute) at greater than 5000 1/min or 10,000 1/min, especially preferably greater than 20,000 1/min or 30,000 1/min, in particular greater than 50,000 1/min or 80,000 1/min.

Preferably, the maximum circumferential speed of the first running wheel 46, the second running wheel 47, the third running wheel 51, and/or the rotor 61 is greater than 10 m/s or 20 m/s, especially preferably greater than 30 m/s or 40 m/s.

Preferably, the (premixed) water-fuel emulsion is then conveyed or pumped past and/or through the rotor 61. In particular, the water-fuel emulsion flows laterally around the rotor 61.

Preferably, the water-fuel emulsion is deflected in the flow channel and/or emulsifying channel and/or emulsifying chamber, preferably by means of the guide apparatus 53 and/or the guide channels 55. The guide channels 55 direct the water-fuel emulsion preferably transversely, particularly at least substantially perpendicularly, to the plane of rotation of the following running wheel 47, 51 onto the blades and/or teeth 49, 52 thereof.

Preferably, the—particularly deflected—water-fuel emulsion is fed to the second stage 45 and/or second running wheel 47.

Preferably, the water-fuel emulsion is (further) homogenized, mixed, or emulsified in the second stage 45 or by means of the second running wheel 47, and/or the water droplets are further reduced or disintegrated in the second stage 45 and/or by means of the second running wheel 47.

The water-fuel emulsion is preferably circulated in the emulsifying chamber, particularly by means of the guide apparatus 53, and/or at least a portion of the water-fuel emulsion is conducted counter to the main direction of flow, preferably such that the dwell time of the water-fuel emulsion in the emulsifying device 4 increases. For this purpose, a radially outwardly directed pressure can be generated by the running wheel 47, 51, which causes emulsion to flow back counter to the main flow direction and along the shaft 34 back to the running wheel 47, 51. The emulsion is further homogenized as a result, and a homogenized emulsion is made available with little emulsion being removed and without water and fuel separating again or demixing.

Preferably, the water-fuel emulsion is further mixed or homogenized in an optional third stage 50. For this purpose, the emulsion can be directed again by guide channels 56, preferably transversely, particularly at least substantially perpendicularly, to the plane of rotation of the third running wheel 51 on the blades and/or teeth 52 thereof.

Preferably, the water-fuel emulsion is (subsequently) fed via the outlet 41 to the injection nozzle 5.

Especially preferably, the water-fuel emulsion is (further) emulsified or homogenized in the injection nozzle 5, the injection nozzle 5 preferably being embodied as a third stage 50 or additional emulsifying stage.

The injection nozzle 5, particularly the distributor chamber or vortex chamber thereof, preferably forms in this regard an additional emulsifying stage, particularly for high-pressure emulsion.

Preferably, the water-fuel emulsion is atomized or misted and/or emulsified in the injection nozzle 5 such that the average water droplet size is less than 1 μm.

It is therefore proposed to use a preferably multistage rotor-stator emulsifying device or fluid flow machine and/or the emulsifying device 4 together with the injection nozzle 5 in order to produce the water-fuel emulsion for the internal combustion engine 1, particularly together or as a structural unit.

Preferably, the speed of the emulsifying device 4, of the drive 59 and/or of the rotor 61 is controlled by means of the control device 25, particularly as a function of the engine speed, the engine torque, and/or the cooling temperature.

Preferably, the emulsifying system 3, particularly the emulsifying device 4 and/or the injection nozzle 5, is flushed with (pure) fuel as needed, the fuel and/or emulsion residues preferably being fed to the leakage line 30 and/or the water separator 31.

Preferably, the water-fuel emulsion is fed by means of the injection nozzle 5 to an associated cylinder and/or injected into an associated combustion chamber.

Individual aspects and features of the present invention as well as individual method steps can be implemented independently of each other or also in any combination and/or sequence.

LIST OF REFERENCE SYMBOLS

| | |
|---|---|
| 1 | combustion engine |
| 2 | injection system |
| 3 | emulsifying system |
| 4 | emulsifying device |
| 5 | injection nozzle |
| 6 | common rail |
| 7 | injection line |
| 8 | fuel tank |
| 9 | fuel precompression pump |
| 10 | fuel filter |
| 11 | fuel meter |
| 12 | high-pressure fuel pump |
| 13 | fuel supply line |
| 14 | high-pressure control |
| 15 | fuel return line |
| 16 | fuel meter |
| 17 | water tank |
| 18 | water precompression pump |
| 19 | water filter |
| 20 | high-pressure water pump |
| 21 | water supply line |
| 22 | drive |
| 23 | pump |
| 24 | valve |
| 25 | control device |
| 26 | fuel pressure sensor |
| 27 | water pressure sensor |
| 28 | bypass line |
| 29 | bypass valve |
| 30 | leakage line |
| 31 | water separator |
| 32 | water return line |
| 33 | housing |
| 33A | inner side |
| 34 | shaft |

-continued

| | |
|---|---|
| 35 | first lid |
| 36 | second lid |
| 37 | bearing |
| 38 | coating |
| 39 | fuel inlet |
| 40 | water inlet |
| 41 | outlet |
| 42 | bearing star |
| 43 | radial supports |
| 44 | first stage |
| 45 | second stage |
| 46 | first running wheel |
| 47 | second running wheel |
| 48 | blades and/or teeth (first running wheel) |
| 49 | blades and/or teeth (second running wheel) |
| 50 | third stage |
| 51 | third running wheel |
| 52 | blades and/or teeth (third running wheel) |
| 53 | first guide apparatus |
| 54 | second guide apparatus |
| 55 | guide channels (first guide apparatus) |
| 56 | guide channels (second guide apparatus) |
| 57 | radial gap |
| 58 | recesses |
| 59 | drive |
| 60 | stator |
| 61 | rotor |
| 62 | coils |
| M | engine load |
| N | engine speed |
| R | rotation axis |
| T | cooling-water temperature |

The invention claimed is:

1. An emulsifying device that is capable of producing a water-fuel emulsion for an internal combustion engine, wherein the emulsifying device is embodied as a rotor-stator-emulsifying device or fluid flow machine, the emulsifying device comprising a housing and a shaft, wherein the emulsifying device has at least one of the following features:

the shaft being drivable in a contactless manner; or the shaft being drivable magnetically.

2. The emulsifying device according to claim 1, wherein the emulsifying device comprises a pre-emulsifying stage and a fine emulsifying stage.

3. The emulsifying device according to claim 2, wherein the housing comprises or forms a guide apparatus with a plurality of guide channels for guiding the flow, wherein the guide apparatus is arranged immediately before or upstream from one of the stages or running wheel(s) thereof.

4. The emulsifying device according to claim 3, wherein the guide apparatus is embodied so as to apply a deflected or directed flow or water-fuel emulsion to a downstream running wheel.

5. The emulsifying device according to claim 3, wherein the guide apparatus encloses the shaft radially.

6. The emulsifying device according to claim 3, wherein the guide apparatus is connected in at least one of a form-fitting, force-fitting, and bonded manner to the housing and/or is integrally formed with the housing.

7. The emulsifying device according to claim 3, wherein the guide apparatus protrudes into the flow channel.

8. The emulsifying device according to claim 1, wherein the emulsifying device has a drive with a stator and a rotor.

9. The emulsifying device according to claim 8, wherein the rotor comprises a permanent magnet.

10. The emulsifying device according to claim 8, wherein the rotor is arranged between two stages of the emulsifying device.

11. The emulsifying device according to claim 8, wherein the rotor is or can be flowed around at least partially.

12. The emulsifying device according to claim 1, wherein the emulsifying device has a first lid and a second lid, with at least one of the lids sealing the housing axially and the shaft being supported in the lids.

13. The emulsifying device according to claim 2, wherein at least one of the pre-emulsifying stage and the fine emulsifying stage is embodied as an axial stage.

14. The emulsifying device according to claim 11, wherein the rotor is or can be flowed around at least partially with the emulsion formed by the first stage.

* * * * *